US005169305A

United States Patent [19]

Kee

[11] Patent Number: 5,169,305

[45] Date of Patent: Dec. 8, 1992

[54] MULTI-PURPOSE GAS LIGHTER

[76] Inventor: Doo-Seok Kee, 400-11 Seogyo-dong, Mapo-ku, Seoul, Rep. of Korea

[21] Appl. No.: 676,697

[22] Filed: Mar. 29, 1991

[30] Foreign Application Priority Data

Jan. 14, 1991 [KR] Rep. of Korea ..... 410/91

[51] Int. Cl.[5] ..... F23Q 2/16; B67B 7/40

[52] U.S. Cl. ..... 431/253; 431/343; 7/151; 81/3.57

[58] Field of Search ..... 431/253, 254, 343; 81/3.57, 3.55, 3.09; 7/151, 167; 239/34, 57, 60; 422/120, 123, 126

[56] References Cited

U.S. PATENT DOCUMENTS

| | | | |
|---|---|---|---|
| 2,521,630 | 9/1950 | Florman | 431/253 X |
| 3,888,416 | 6/1975 | Lin | 239/60 X |
| 4,241,626 | 12/1980 | Hall | 81/3.55 |
| 4,287,794 | 9/1981 | Kubach et al. | 81/3.55 |
| 4,373,223 | 2/1983 | Miller | 431/253 X |
| 4,373,246 | 2/1983 | Van Houtte et al. | 81/3.55 |
| 4,560,344 | 12/1985 | Kietaibl | 431/253 |
| 4,583,939 | 4/1986 | Brickwedde | 431/253 |
| 4,642,827 | 2/1987 | Karuzas | 431/253 X |
| 4,712,454 | 12/1987 | Hull et al. | 81/3.55 |

FOREIGN PATENT DOCUMENTS

| | | | |
|---|---|---|---|
| 606514 | 4/1990 | Rep. of Korea . | |
| 903780 | 7/1990 | Rep. of Korea . | |
| 29627 | 3/1919 | Norway | 7/167 |
| 583140 | 12/1976 | Switzerland | 81/3.09 |
| 319054 | 9/1929 | United Kingdom | 431/253 |
| 323664 | 1/1930 | United Kingdom | 81/3.09 |

*Primary Examiner*—Carl D. Price

*Attorney, Agent, or Firm*—Finnegan, Henderson, Farabow, Garrett and Dunner

[57] ABSTRACT

This invention relates to a multi-purpose gas lighter which has an incurve in the body to receive the hem ridge of a drink can, a can tab lifting device, a bottle opening device, a perfume chamber for emission of fragrance, and a triangle piece to hang key rings and other items on, all these in addition to the fire-lighting section of ordinary lighters.

2 Claims, 2 Drawing Sheets

MULTI-PURPOSE GAS LIGHTER

BACKGROUND OF THE INVENTION

This invention relates to a multi-purpose lighter, and, in particular, to a new type of gas lighter, the body part of which has a bottle opener and can-tab lifter, a perfume chamber, and a triangle for holding key rings.

Among gas lighters which have purposes other than lighting proper those publicized as Korea Utility Model Publications Nos. 90-3780 and 90-6514, along with that in application No. 90-10412, can be cited. The characteristics common to these gas lighters of prior art are their invariably long elliptical bodies of synthetic resin having an opener fitted to the rear end of the body.

The openers on prior art gas lighters are admittedly fit for removing metal caps of bottles and the like but are by no means fit to remove tabs of metal cans of drinks. Hence, the need for something like the present invention.

SUMMARY OF THE INVENTION

The present invention is intended to provide a multi-purpose gas lighter with an opener, which unlike those on the multi-purpose gas lighters of prior art, is also fit for removing the tabs of tin cans along with a perfume chamber to emit a pleasant fragrance, and a triangle fitted to the rear end of the body on which one can suspend a key ring or the like.

BRIEF DESCRIPTION OF THE DRAWINGS

The accompanying drawings, which are incorporated in, and constitute a part of, the specification, illustrate at least one embodiment of the invention and, together with the description, explain the principles of the invention.

FIG. 8 is a sectional view of the perfume chamber of the multipurpose gas lighter of the present invention with the stopper on;

DETAILED DESCRIPTION OF THE INVENTION

Figure 1:
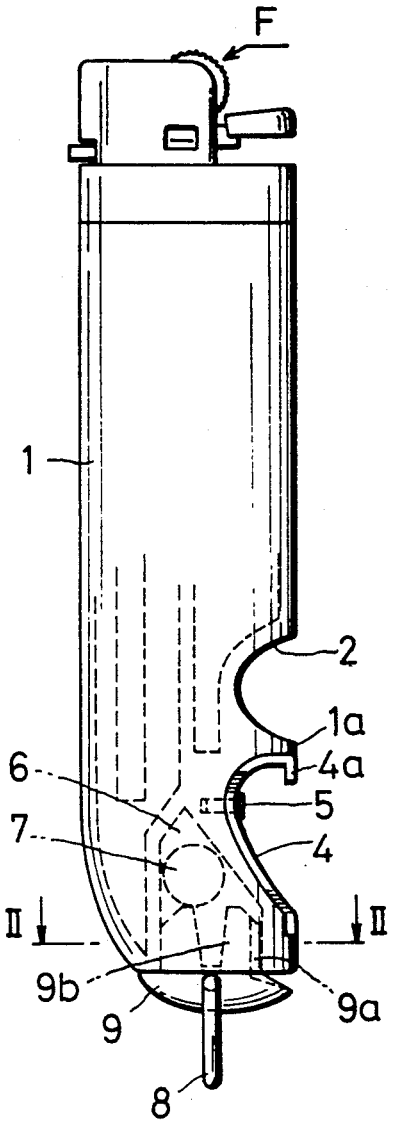
FIG. 1 is a plan view of the multi-purpose gas lighter of the present invention.
Figure 2:
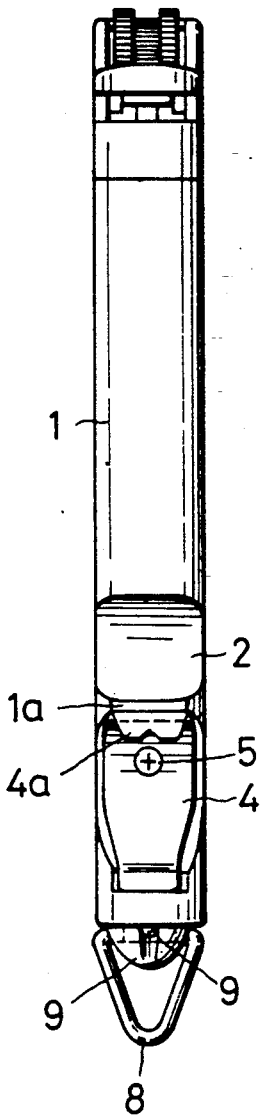
FIG. 2 is a side view of the multi-purpose gas lighter of the present invention.
Figure 3:
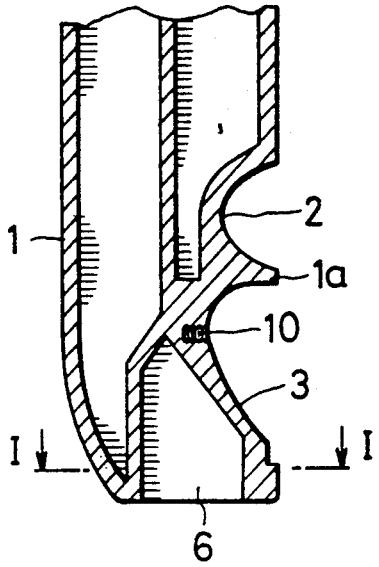
FIG. 3 is a sectional of the lower half of the body of the multi-purpose gas lighter of the present invention.
Figure 4:
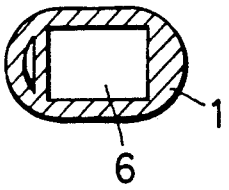
FIG. 4 is a sectional view of the multi-purpose gas lighter of the present invention taken along line I—I of FIG. 3.
Figure 5:
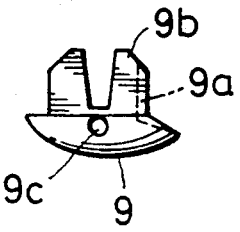
FIG. 5 is a plan view of the stopper of the perfume chamber of the multi-purpose gas lighter of the present invention.
Figure 6:
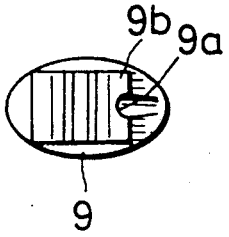
FIG. 6 is a top view of the stopper of the perfume chamber of the multi-purpose gas lighter of the present invention.

An example of preferred embodiments of the present invention is described below with the aid of the attached drawings:

As is seen in FIGS. 1–3, the longish body 1 of the lighter has in its lower half a first identation 2; a second identation comprising an opener section 3, the first indentation 2 being intended merely for receiving the elevated ridge along the hem of tin cans, always higher than the plane top of ordinary cans, and a perfume chamber 6.

The identation 2 and the opener section 3 are separated from each other by a partition 1*a*.

The incurve 2 for reception of the drink can's hem ridge, formed in a smooth easy curve in the illustration, can be made in yet other forms, e.g. various trancated polygons

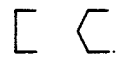

But it must be cut in to fully admit the height of the hem ridge or ordinary tin cans. If it is too shallow, the hem ridge of tin cans can not enter in its entirety, making it impossible for the catch 4*a* of the can tab lifter to be inserted beneath the slightly turned-up loose end of the tab.

The opener section 3 has a similar shape to the back side of the opener piece 4, and also has a screw groove 10 at a proper position.

The screw groove 10, with a screw driven therein, is used for fixing the opener piece 4.

The opener piece 4, meanwhile, has a catch 4*a*, which, in operation, catchs beneath the underside edge of a bottle cap or the ring of the tab of a tin can from underneath. The catch 4*a* is placed, when the opener piece 4 is fixed onto the opener section 3', at the of the opener section nearest where force is applied to the body.

In example 1 the lighting section F is where force is applied, and so the opener piece 4 is fixed in a manner so that the catch 4*a* is located at a position near the identation 2.

The shape of the perfume chamber 6 is optional; only the bottom is open.

The aroma to be put inside should be either granule or powder, but in order to keep it from leaking freely, it is preferable to choose something of a granular type. If aroma of a powder type is used, however, it is quite all right. But it is necessary to fix a net of fine meshes on the passage to prevent undesired leakage of the aroma.

In the stopper 9, which closes the opening of the perfume chamber 6, a groove 9*a* is cut forming the passage h for emission of the fragrance outwards, and this groove 9*a* runs from the outer end of a leg 9*b* of the stopper 9 through the upper side of the stopper 9.

Figure 7:
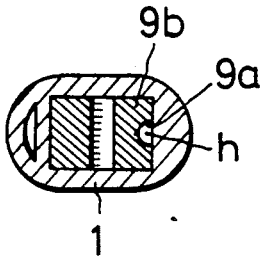
FIG. 7 is a sectional view of the multi-purpose gas lighter of the present invention taken along the II—II of FIG. 1.
Figure 8:
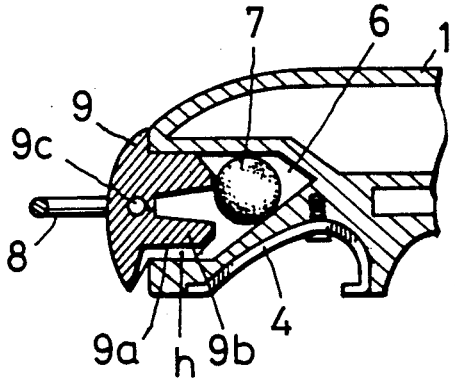

The lateral section of the part closed up by the stopper 9 is as is shown in FIG. 7, and the groove 9*a* of the stopper 9, whose open side is closed up by an inside surface of the chamber 6, forms a passage (h) in the shape of a vertically cut duct or a tunnel, extending straight from top to bottom. It is by this very passage (h) that the sweet fragrance emits and floats around the gas lighter.

In the stopper 9 there is a through hole 9*c* from one side to the other, and through this hole 9*c* both ends of a triangle 8 are elastically put through. This triangle 8 is used for hanging key rings, a shoehorn, a nail clipper, and so on.

As for the perfume 7, whatever kind is chosen can be replenished whenever necessary. The stopper 9 is pulled out to replenish used-up perfume or replace it with something new.

Figure 9:
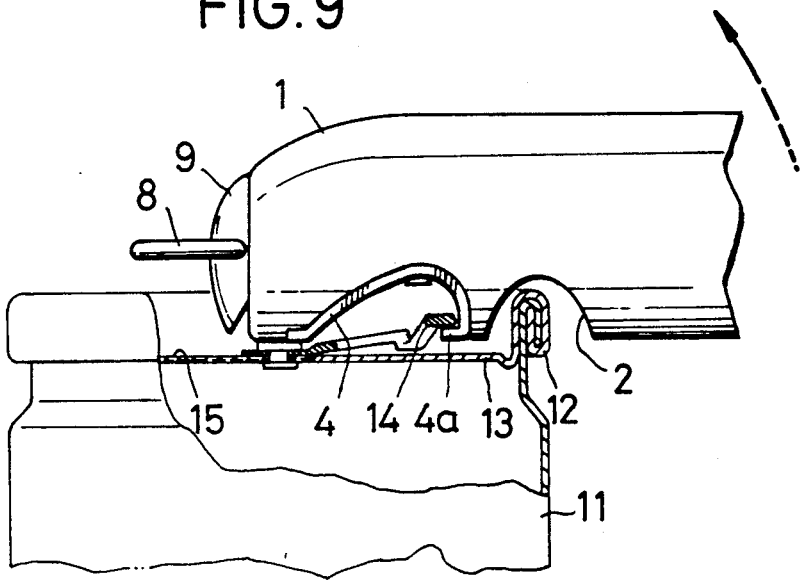
FIG. 9 is a partial sectional view of the opener of the multi-purpose gas lighter of the present invention set in position to lift the tab of a tin can, with its catch inserted beneath the slightly turned-up loose end of the tab.

The lifting of a can tab by the use of the identation 2 and the opener section 3 is described as follows;

FIG. 9 illustrates the opener made ready to lift the tab of a can.

In this illustration, the identation 2 admits the hem ridge 12 of the can 11 with no difficulty so the catch 4*a* of the opener piece 4 contacts the flat top 13 of the can 11. The tab on the flat top 13 of the can 11 being turned up slightly at the outer end to give just enough room for a finger nail to be inserted, the catch 4*a* of the opener piece 4 can be inserted between the ring 14 and the flat top 13 of the can 11 to catch fast the ring 14. By applying force in the direction indicated by the arrow it is possible to lift the tab 15 for its removal.

The way of opening a bottle, removing the cap, is so well known that its explanation is omitted.

As has been described above, the multi-purpose gas lighter of the present invention, with its bottle opener, can tab lifter, perfume chamber, and triangle for key rings, etc., in addition to the lighter proper, can be said to be convenient and of more use than the multi-purpose gas lighter which has prior art consisting only of a built-in bottle opener.

What is claimed is:

1. A multi-purpose lighter and container opener comprising:

an elongated casing having a longitudinal axis, an outer surface, a compartment for containing fuel, and means for igniting fuel to cause a flame disposed at one end of said casing;

a container lid removal means for removing a lid from a top portion of a container and disposed on said outer surface near the other end of said casing, including a first indentation and a second indentation, said first and second indentations defining a raised edge therebetween extending substantially radially from said longitudinal axis, and a lip disposed on said raised edge extending substantially perpendicular to said raised edge and into said first indentation, said first indentation for receiving a top portion of a container with at least a portion of the container lid being disposed between said longitudinal axis and said lip, the container lid being removable from the container by rotating said casing relative to the container;

a perfume compartment disposed within said casing for containing a fragrant substance;

a removable stopper for sealing the fragrant substance within said perfume compartment, said removable stopper defining a passage therethrough in communication with said perfume compartment for allowing fragrance to be emitted from said perfume compartment without removing said stopper from said perfume compartment, said stopper defining a hole therethrough; and a triangular loop including two angle portions and two colinear extending portions each adjacent to one of said angle portions, said extending portions rotatably disposed within said hole in said stopper.

2. A multi-purpose lighter and container opener as in claim 1, further comprising a fragrant substance placed in said perfume compartment.

* * * * *